US011794194B2

(12) United States Patent
Rogers et al.

(10) Patent No.: US 11,794,194 B2
(45) Date of Patent: Oct. 24, 2023

(54) SHREDDER BLADE ASSEMBLY

(71) Applicant: Eco Green Equipment, LLC, North Salt Lake, UT (US)

(72) Inventors: Ted Bushman Rogers, West Haven, UT (US); Michael Bradley Swenson, North Salt Lake, UT (US)

(73) Assignee: Eco Green Equipment, LLC, North Salt Lake, UT (US)

( * ) Notice: Subject to any disclaimer, the term of this patent is extended or adjusted under 35 U.S.C. 154(b) by 325 days.

(21) Appl. No.: 17/121,116

(22) Filed: Dec. 14, 2020

(65) Prior Publication Data

US 2021/0094042 A1 Apr. 1, 2021

Related U.S. Application Data

(63) Continuation of application No. 14/282,093, filed on May 20, 2014, now Pat. No. 10,864,523.

(51) Int. Cl.
*B02C 18/18* (2006.01)
*B02C 18/14* (2006.01)

(52) U.S. Cl.
CPC ..... *B02C 18/18* (2013.01); *B02C 18/142* (2013.01); *B02C 18/184* (2013.01); *B02C 2210/02* (2013.01)

(58) Field of Classification Search
CPC ..... B02C 18/18; B02C 18/184; B02C 18/142; B02C 2210/02
See application file for complete search history.

(56) References Cited

U.S. PATENT DOCUMENTS 1,013,509 A * 1/1912 Nelson ..... B02C 18/186 241/242
1,032,081 A * 7/1912 Penn ..... B02C 4/12 241/243
2,141,663 A * 12/1938 Ossing ..... B02C 18/0092 144/233
2,986,347 A * 5/1961 Stevenson ..... B02C 13/2804 241/73
3,229,921 A * 1/1966 Hess ..... B02C 18/14 241/190

(Continued)

FOREIGN PATENT DOCUMENTS

SU 961770 A 9/1982

*Primary Examiner* — Sean M Michalski
(74) *Attorney, Agent, or Firm* — Travis Banta; Loyal IP Law, PLLC

(57) ABSTRACT

A shredder blade assembly is disclosed having a rotor configured to be mounted on a rotating shaft, the rotor having opposing faces with a plurality of angled knife receptacles and a plurality of knife inserts mounted within the plurality of knife receptacles. Each knife insert has two opposing faces and each opposing face comprises three cutting edges such that each knife insert has six cutting edges. Only one of the cutting edges is exposed at an outer peripheral edge of the shredder blade assembly during use. The knife inserts are configured to be removed, rotated (and flipped as needed), and re-mounted within the plurality of knife receptacles to expose another of the cutting edges at the outer peripheral edge of the shredder blade assembly. The knife insert may be triangular and mounted to expose one vertex to create a plurality of tooth/hook projections.

17 Claims, 6 Drawing Sheets

(56) References Cited

U.S. PATENT DOCUMENTS 3,367,585 A * 2/1968 Ratkowski ..... B02C 13/28 241/300
3,595,290 A * 7/1971 Tassev ..... B02C 11/00 241/185.5
3,658,265 A * 4/1972 Johnson ..... B02C 18/145 241/243
4,241,882 A * 12/1980 Baikoff ..... B02C 18/184 241/DIG. 31
4,350,308 A * 9/1982 Brewer ..... B02C 18/184 144/237
4,374,573 A * 2/1983 Rouse ..... B29B 17/0412 241/DIG. 31
4,607,800 A * 8/1986 Barclay ..... B02C 18/184 241/DIG. 31
4,717,085 A * 1/1988 Crane ..... B02C 18/0007 241/292.1
4,773,600 A * 9/1988 Metski ..... B02C 18/145 241/101.76
4,799,627 A * 1/1989 Potts ..... B02C 18/142 241/300
4,834,302 A * 5/1989 Baker ..... B02C 13/04 241/101.78
4,901,929 A * 2/1990 Barclay ..... B02C 18/142 241/294
4,945,640 A * 8/1990 Garg ..... C23C 16/08 30/350
4,981,270 A * 1/1991 Reber ..... B02C 18/0007 241/166
5,042,733 A * 8/1991 Hench ..... B02C 18/186 241/294
5,275,342 A * 1/1994 Galanty ..... B02C 18/142 241/73
5,285,973 A * 2/1994 Goforth ..... B02C 18/182 241/36
5,318,231 A * 6/1994 Bernhardt ..... B02C 18/184 241/300
5,375,775 A * 12/1994 Keller ..... B02C 18/144 241/242
5,680,999 A * 10/1997 Wada ..... B02C 18/142 83/664
5,873,534 A * 2/1999 Shinn ..... B02C 18/145 241/294
6,024,312 A * 2/2000 Spiesshofer ..... B02C 18/142 241/166
6,053,442 A * 4/2000 Matsuo ..... B02C 18/14 241/242
6,176,445 B1 * 1/2001 Shinn ..... A01G 23/067 241/294
6,375,106 B1 * 4/2002 Sears ..... B02C 18/142 241/294
6,439,486 B1 * 8/2002 Nitta ..... B02C 18/184 241/DIG. 31
7,100,855 B2 * 9/2006 Diemunsch ..... B02C 18/184 241/DIG. 31
7,124,969 B2 * 10/2006 Lietaer ..... A01G 3/002 241/242
7,334,748 B2 * 2/2008 Maynard ..... B02C 18/145 241/243
7,418,986 B2 * 9/2008 Watts ..... B02C 18/184 144/241
7,500,630 B2 * 3/2009 Rogers ..... B02C 18/18 241/300
7,975,945 B1 * 7/2011 Lo ..... B02C 18/142 241/166
D655,731 S * 3/2012 Cox ..... B02C 18/145 D15/139
8,167,225 B2 * 5/2012 Gaudreault ..... B23C 5/2239 241/101.77
8,646,714 B2 * 2/2014 Chen ..... B02C 18/0007 144/233
8,646,715 B2 * 2/2014 Pellman ..... A01K 5/001 241/101.76
8,919,683 B2 * 12/2014 Kim ..... B02C 19/0056 241/243
8,967,515 B2 * 3/2015 Pallmann ..... B02C 18/145 241/293
9,016,284 B2 * 4/2015 Tilley ..... A24C 5/00 131/117
9,561,551 B2 * 2/2017 Diego ..... B02C 18/18
9,573,137 B2 * 2/2017 Van der Galien ..... B02C 4/34
9,776,192 B2 * 10/2017 Ebadian ..... B02C 25/00
2002/0074436 A1 * 6/2002 Hruska ..... A01F 29/005 241/194
2004/0251360 A1 * 12/2004 Everson ..... B02C 4/30 241/294
2009/0008491 A1 * 1/2009 Sharp ..... E02F 9/2866 241/294
2011/0108650 A1 * 5/2011 Lin ..... B02C 18/142 241/236
2016/0288353 A1 * 10/2016 McCracken ..... B26D 1/29
2017/0095821 A1 * 4/2017 Lyman ..... B02C 13/04
2017/0252749 A1 * 9/2017 Miller ..... B02C 18/145

* cited by examiner

A3

SECTION B/3 – B/3

SECTION C/4-C/4

SECTION A-A

SHREDDER BLADE ASSEMBLY

PRIORITY CLAIM

This application claims the priority and benefit of U.S. Pat. No. 10,864,523, filed on May 20, 2014. U.S. Pat. No. 10,864,523 is incorporated by reference in its entirety.

TECHNICAL FIELD

This disclosure relates to a shredder blade assembly that includes interchangeable knife inserts with six cutting edges.

BACKGROUND

Industrial shredding machines are used to shred or reduce objects into smaller pieces for reuse or recycle. Shredding machines are commonly rotary shredders comprising pairs of counter-rotating, intermeshing, serrating and shearing blade assemblies or cutting wheels. The blade assemblies are mounted on parallel rotating shafts. The number of pairs of parallel blade assemblies on a single shaft can vary. A larger number of blade assemblies will increase the capacity of the shredder. The parallel blade assemblies are separated by spacers to allow intermeshing of another set of parallel blade assemblies on another shaft.

In the shredding zone, the tire or article to be shredded encounters the outer periphery of the counter-rotating blade assemblies. After continuous shredding for a period of time, the outer periphery of the blade assembly becomes worn by the toughness of tires or articles being shredded. These cutting or shearing surfaces would need to be resurfaced. The problem of resurfacing cutting wheels has been addressed by using a modular construction of blade assemblies comprising a rotor structure upon which a plurality of cutting and shearing surfaces are attached. The outer peripheral contact region of a blade assembly is removed and replaced instead of removing the entire wheel from its shaft for repair. This is done by removing individual cutting and shearing surfaces, or knives, from the rotor.

It will be appreciated that there is a need in the art for shredder blade assemblies that can be quickly and efficiently maintained to reduce equipment down-time and expensive repair on industrial shredders.

It will further be appreciated that there is a need in the art for shredder blade assemblies with replaceable knife inserts that have a long usable lifespan, thereby lowering maintenance costs.

SUMMARY OF THE INVENTION

A shredder blade assembly is disclosed that includes a rotor upon which are mounted interchangeable knife inserts.

Each knife insert has six cutting or shearing edges. It may have a triangular or modified-triangular shape. During shredder operation, only one of the six cutting edges is subject to wear. After one cutting edge is worn, the knife insert is rotated 120°, thereby exposing another edge. The knife insert may be rotated to expose the three cutting edges on one side of the knife insert. After all three cutting edges on one side are worn, the entire knife insert is flipped over and rotated as needed to expose three additional cutting edges. The knife inserts are held in place by a symmetrical hole pattern that enables correct placement and bolting of the knife insert onto the rotor despite being rotated and flipped.

The knife inserts are preferably fabricated of a high alloy steel and/or tool steel. The knife inserts may optionally be coated with wear resistant surface coatings. The knife inserts may optionally be fabricated with carbide wear edges.

When the knife insert is inserted onto the rotor its triangle shape and the way it is inserted onto the rotor creates a positive angle tooth/hook, much like a saw tooth, that pulls material through the opposing cutting edges more efficiently than other insert types.

In one non-limiting embodiment, the knife inserts are staggered on each side of the rotor so that the teeth/hooks are offset to create a smoother flow of material into the blade assembly as they cut, shear, and shred the material. Without being bound by theory, it is believed that the smoother flow of material into the blade assembly produces less stress and wear on the gears and motors that drive the shredder.

BRIEF DESCRIPTION OF THE DRAWINGS

In order that the manner in which the above-recited and other features and advantages of the invention are obtained will be readily understood, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the shredder blade assembly, is not intended to limit the scope of the invention, as claimed, but is merely representative of present embodiments of the invention.

Figure 1B:
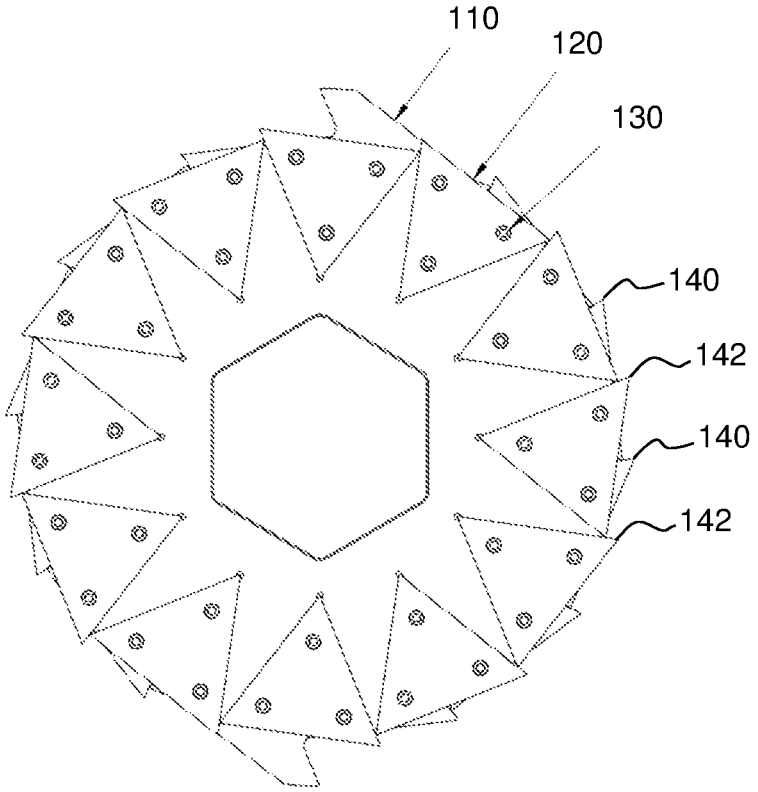
FIGS. 1A, 1B, and 1C are front perspective, front, and side views, respectively, of a shredder blade assembly within the scope of the disclosed invention.
Figure 1C:
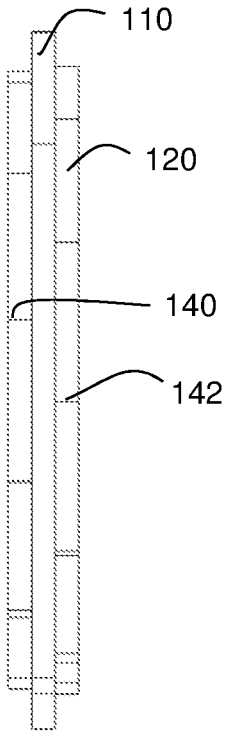
Figure 1A:
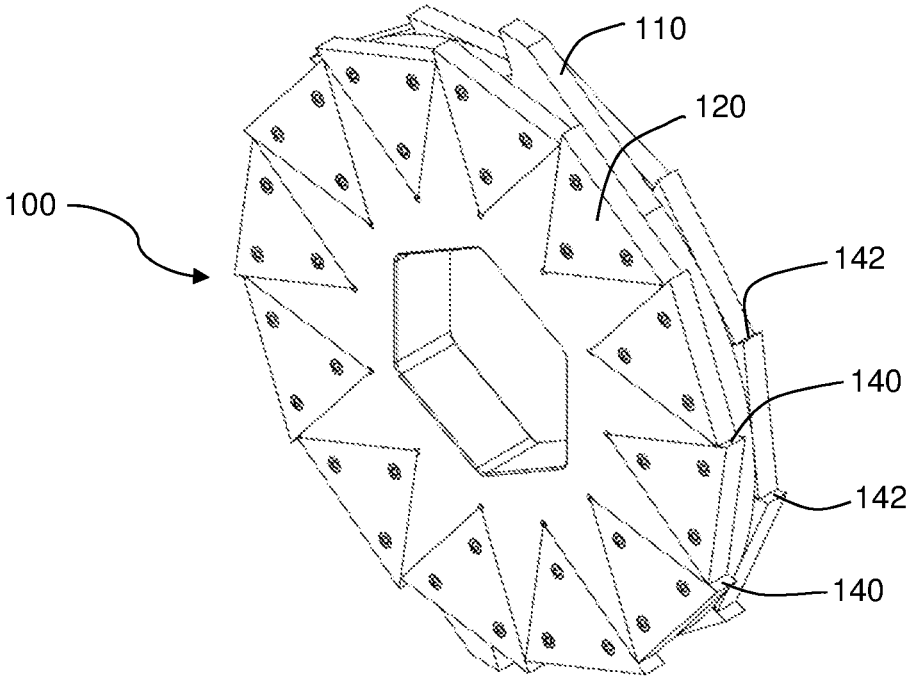

The disclosed invention relates to a shredder blade assembly having interchangeable knife inserts. One non-limiting embodiment of a shredder blade assembly 100 is shown in FIGS. 1A, 1B, and 1C. The shredder blade assembly includes a rotor 110 upon which are mounted a plurality of knife inserts 120. In the illustrated embodiment, 12 knife inserts 120 are mounted on one side of the rotor 110 and 12 other knife inserts 120 are mounted on the opposite side of the rotor 110. It will be appreciated that the number of knife inserts mounted on each rotor may be varied. Thus, the invention is not limited to the specific number of knife inserts shown in the Figures.

The knife inserts 120 are mounted to the rotor using suitable fasteners 130. The fasteners 130 may be screws, such as socket head cap screws. As shown, each rotor may be mounted using screws in a symmetrical screw hole pattern. A symmetrical hole pattern enables correct placement and bolting of the knife insert 120 onto the rotor 110 despite being rotated and flipped. In one disclosed embodiment, three fasteners 130 are used to mount each knife insert 120. In another embodiment, a single centrally located fastener may be used to mount each knife insert 120. It is understood that precise number of holes and fasteners used may vary.

The disclosed knife inserts 120 are preferably made in the shape of an equilateral triangle. They are mounted in a way to expose one vertex of the triangle to create a positive angle tooth/hook 140, 142 much like a saw tooth, that pulls material through the opposing cutting edges more efficiently than other shredder blade insert types. It will be understood that the shape of the knife inserts may be modified to another polygonal shape and still provide six cutting and shearing edges. For instance, the knife insert may have a modified triangular shape, such as a hexagonal shape. As used herein, a modified triangular shape includes a shape that still has three dominant sides or edges, but may not be "technically" a triangle. A modified triangular shape that is hexagonal may be achieved by removing a portion of each vertex of the equilateral triangle. The precise angle and amount removed from each vertex may vary.

In one non-limiting embodiment, the knife inserts are staggered on the each side of the rotor so that the teeth/hooks 140, 142 are offset to create a smoother flow of material into the shredder blade assemblies as they cut, shear, and shred the material. Without being bound by theory, it is believed that the smoother flow of material into the blade assembly produces less stress and wear on the gears and motors that drive the shredder.

Figure 2B:
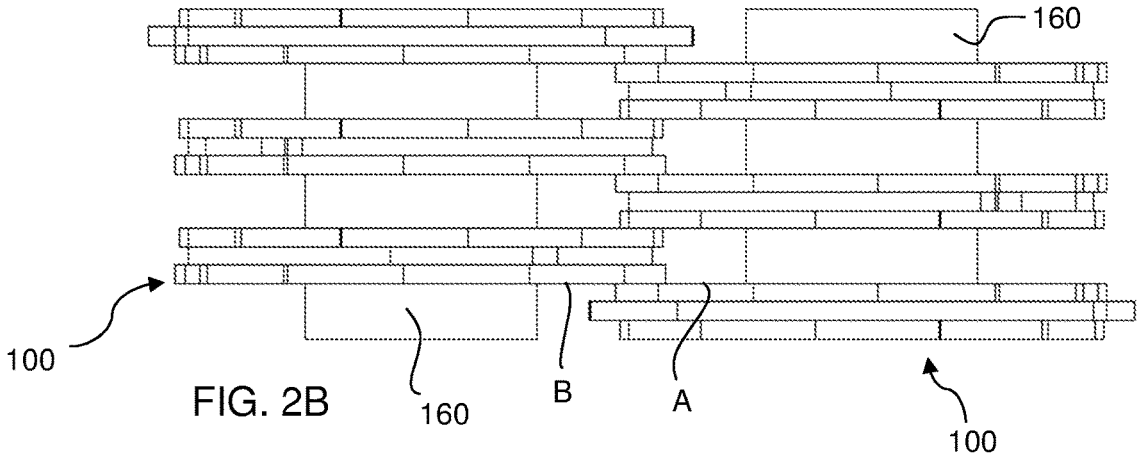
FIGS. 2A and 2B are front and top plan views, respectively, of shredder blade assemblies mounted on shafts.
Figure 2A:
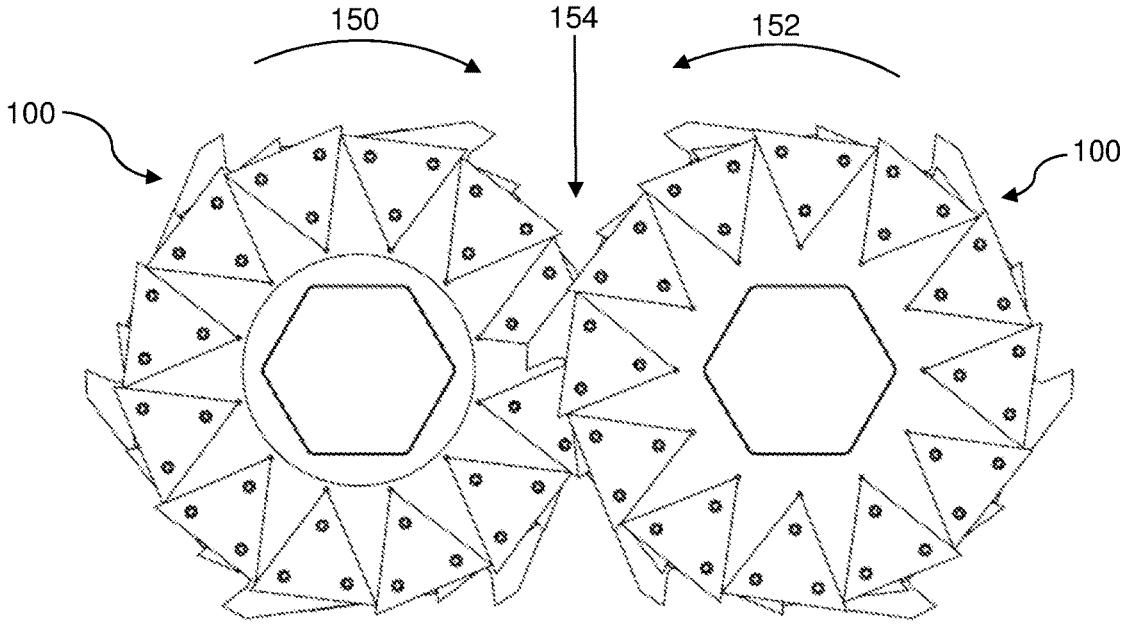

Rotary shredders comprise pairs of counter-rotating, intermeshing, serrating and shearing blade assemblies. FIG. 2A shows a front view and 2B shows a top view of shredder blade assemblies 100 mounted on parallel rotatable shafts. The number of pairs of parallel blade assemblies on a single shaft can vary. A larger number of blade assemblies will increase the capacity of the shredder. It will be appreciated that the number of blade assemblies 100 shown in FIG. 2B is for illustration purposes. The actual number of blade assemblies 100 in a working rotary shredder would typically be greater than the number illustrated in FIG. 2B.

Each shaft rotates in an opposite direction, as shown by arrows 150, 152 so that the article to be shredded is drawn into a shredding zone indicated by arrow 154. Within the shredding zone 154, the exposed outer edge of knife inserts on one blade assembly 100 (identified as "A" in FIG. 2B) contact and interact with the exposed outer edge of knife inserts on the opposed and adjacent blade assembly rotating in the opposite direction (identified as "B" in FIG. 2B). The interacting outer edges cut, shear, or shred the article.

Figure 7B:
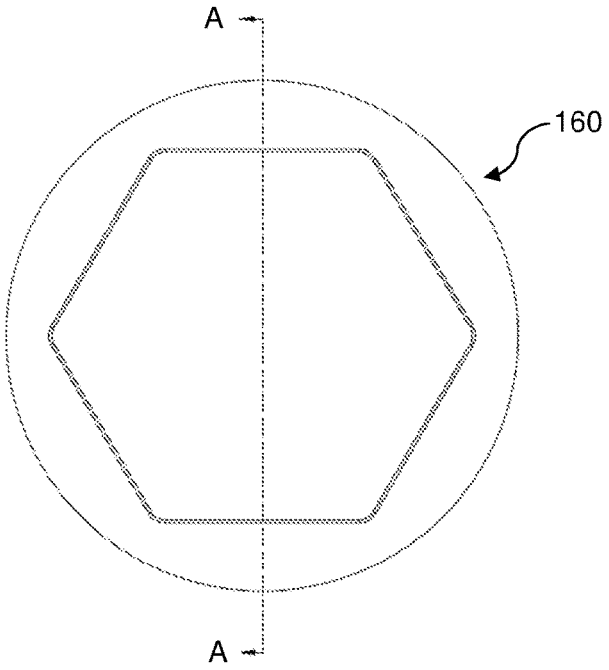
FIGS. 7A, 7B, and 7C are a front perspective, a front, and a cross-section view (taken along line A-A of FIG. 7B), respectively, of a blade assembly spacer within the scope of the disclosed invention.
Figure 7C:
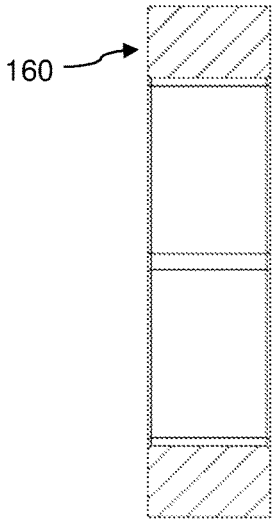
Figure 7A:
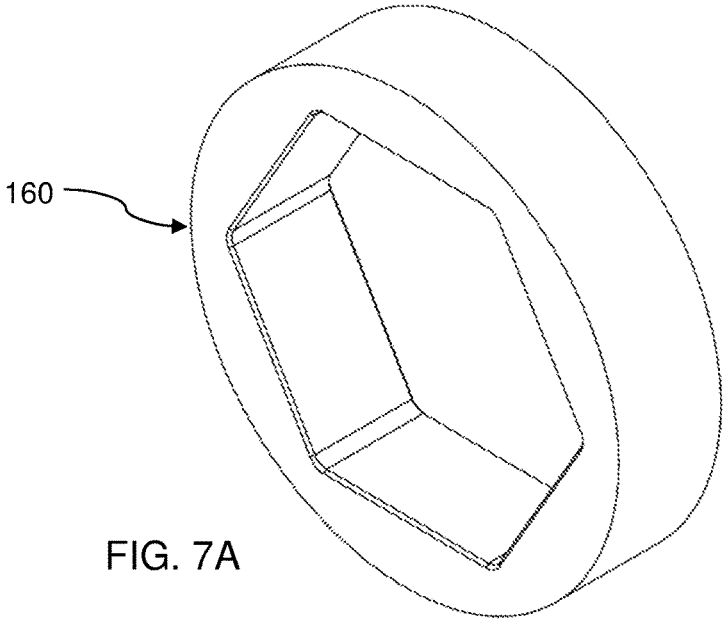

The parallel blade assemblies are separated by spacers 160 to allow proper spacing and intermeshing of an opposing set of parallel blade assemblies on another shaft. The width or thickness of the spacers may vary as needed to ensure that opposing blade assemblies interact to produce the cutting, shearing, or shredding function. A representative example of a blade assembly spacer is shown in FIGS. 7A-7C.

Figure 3B:
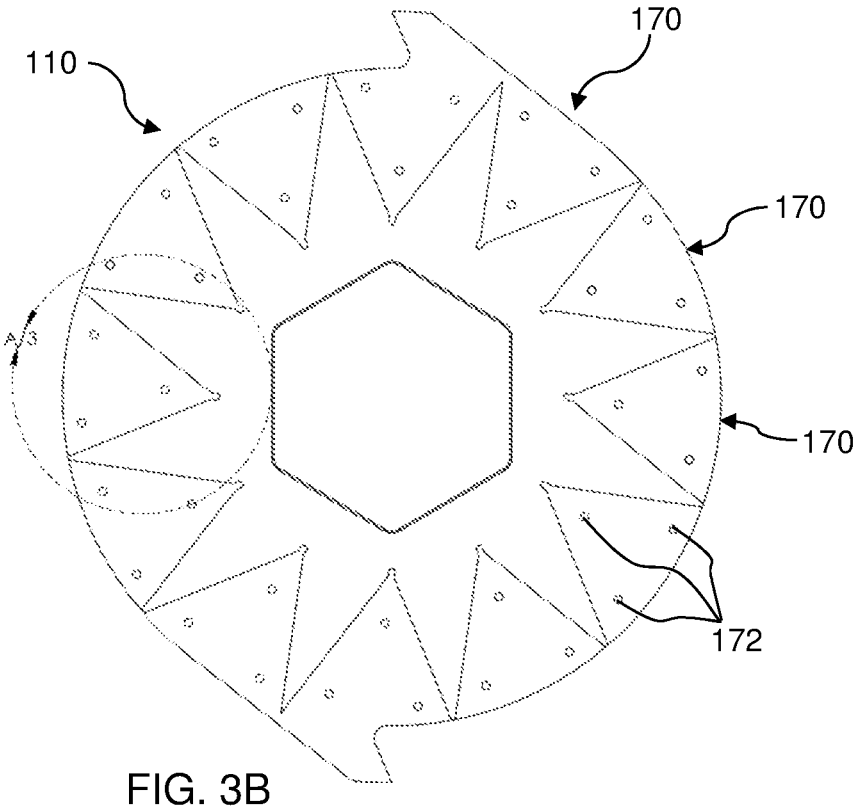
FIGS. 3A, 3B, and 3C are front perspective, front, and side views, respectively, of a rotor within the scope of the disclosed invention.
Figure 3C:
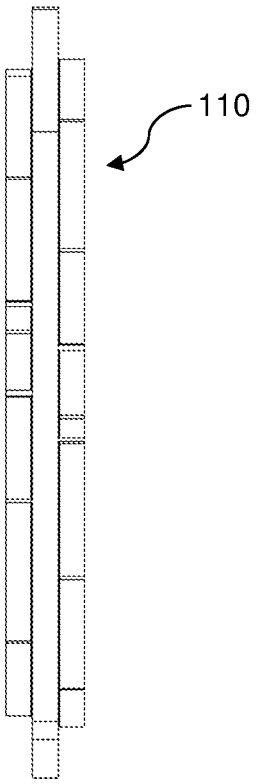
Figure 3A:
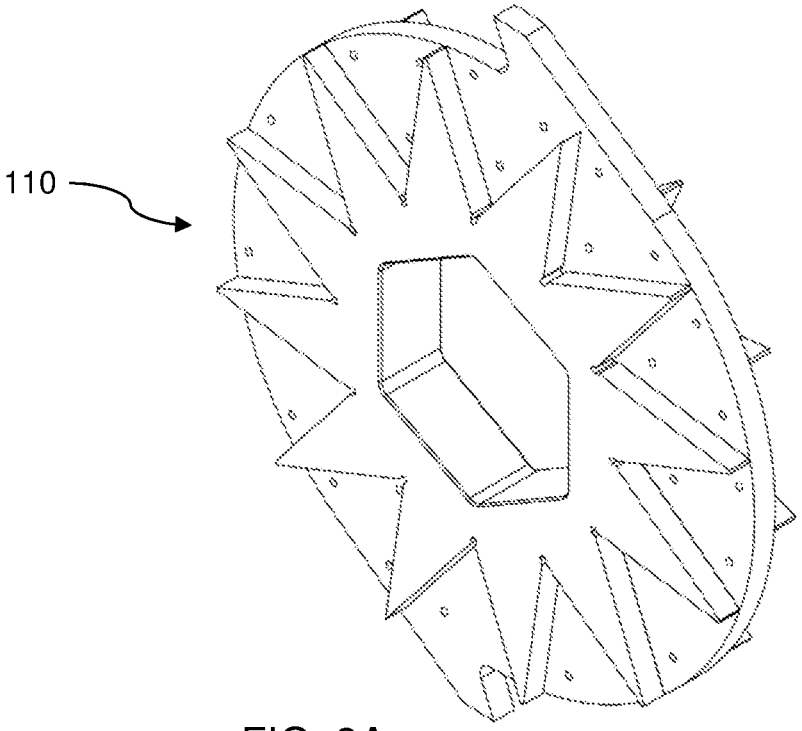

FIGS. 3A-3C illustrate one non-limiting example of a rotor 110 within the scope of the disclosed invention. The rotor 110 is fabricated or machined to include a plurality of knife receptacles 170 sized and configured to receive a plurality of triangular knife inserts mounted on opposite sides of the rotor. While the illustrated embodiment of the rotor 110 may accommodate 12 knife inserts mounted on each side, it is understood that the rotor can be fabricated to accommodate any practical number of knife inserts.

Each knife receptacle includes one or more holes 172 disposed in a symmetrical hole pattern to receive suitable fasteners used to mount a knife insert. As described above, the symmetrical hole pattern enables correct placement and bolting of knife insert onto the rotor 110 despite being rotated and flipped.

Figure 4:
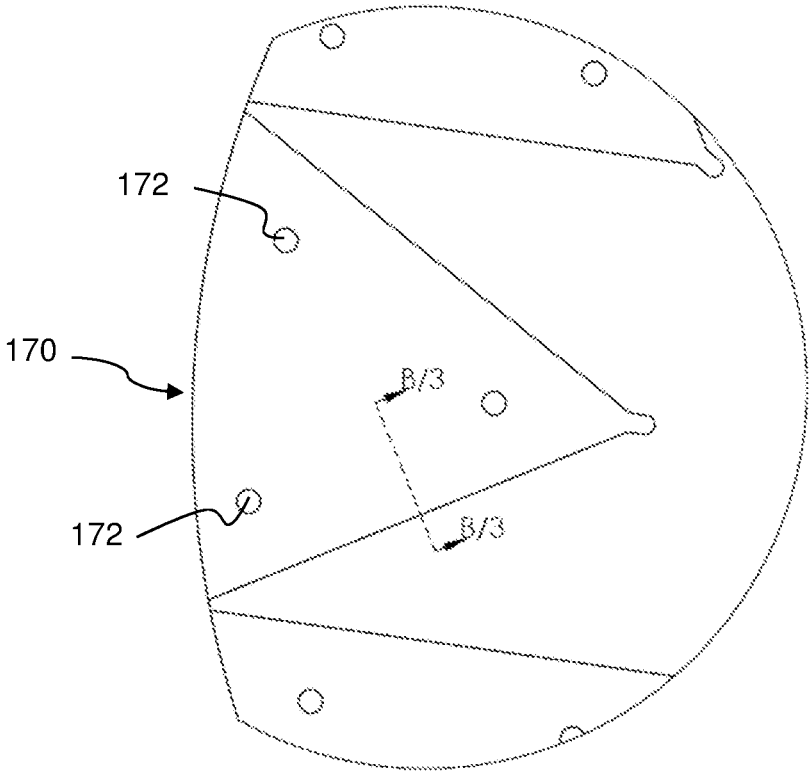
FIG. 4 is an enlarged view of region A3 identified in FIG. 3B.
Figure 5:
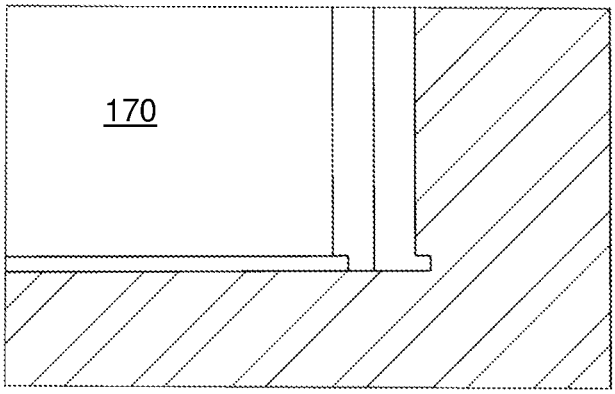
FIG. 5 is an enlarged partial cross-sectional view taken along line B3-B3 of FIG. 4.

FIG. 4 is an enlarged view of the knife receptacle 170 shown in the region A3 identified in FIG. 3B. FIG. 5 is an enlarged partial cross-sectional view taken along line B3-B3 of FIG. 4.

Figure 6B:
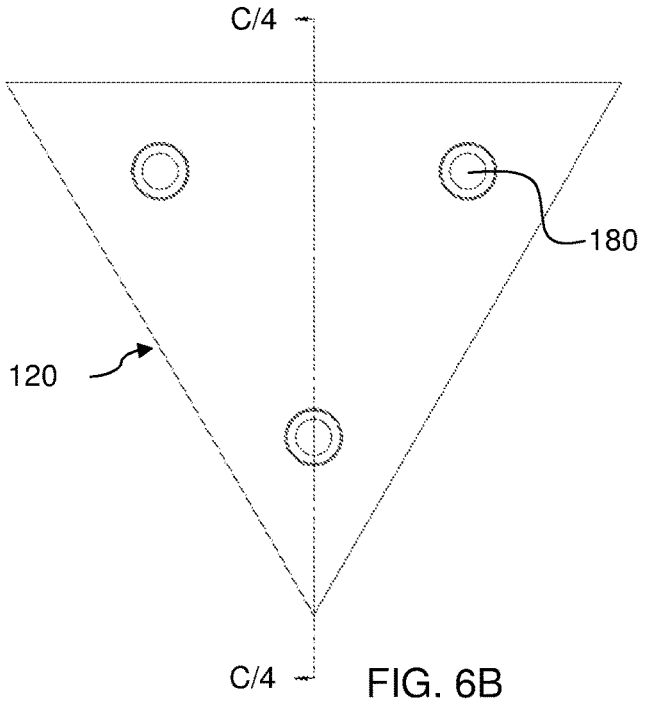
FIGS. 6A, 6B, and 6C are a front perspective, a front, and a cross-sectional view (taken along line C4-C4 of FIG. 6B), respectively, of a knife insert within the scope of the disclosed invention.
Figure 6C:
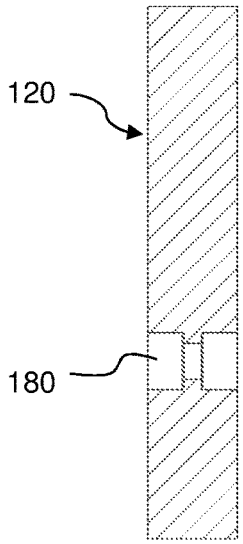
Figure 6A:
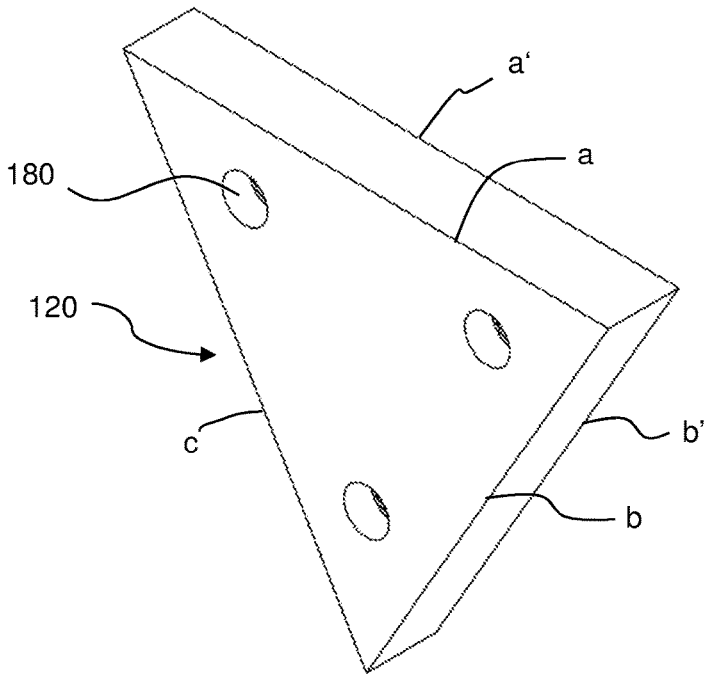

FIGS. 6A-6C show details of a knife insert 120. As described above, each knife insert 120 is triangular shaped, thereby providing six cutting or shearing edges, labelled in FIG. 6A as edges a, b, c on one side and edges a' and b' on the opposite side, with edge c' being hidden in the perspective view by edge c. During shredder operation, only the exposed outer edge of each knife insert is subject to wear. Thus, only one of the six edges is subject to wear during shredder operation. After one cutting edge is worn, the knife insert is removed from the rotor, rotated 120°, and reinstalled to the rotor, thereby exposing another edge. The knife insert 120 is rotated as needed to expose the three cutting edges on one side of the knife insert. After all three cutting edges on one side are worn, the entire knife insert 120 is flipped over and rotated as needed to expose three additional cutting edges.

The ability to use a knife insert with six cutting or shearing edges greatly extends the useful life of the knife insert. This can reduce operating and maintenance costs for the shredder.

The knife inserts 120 are mounted to the rotor by fasteners 130 using holes 180 arranged in a symmetrical hole pattern that enables correct placement and bolting of the knife insert 120 onto the rotor 110 despite being rotated and flipped, as described above.

The knife inserts are preferably fabricated of a high alloy steel and/or hardened tool steel. The knife inserts may optionally be coated with wear resistant surface coatings. In a non-limiting embodiment, the knife inserts are fabricated with carbide wear edges.

While specific embodiments and examples of the present invention have been illustrated and described, numerous modifications come to mind without significantly departing from the spirit of the invention, and the scope of protection is only limited by the scope of the accompanying claims.

The invention claimed is:

1. A shredder blade, comprising:

a rotor comprising:

one or more knife receptacles, the one or more knife receptacles being recessed into a first face of the rotor and a second face of the rotor, the first face of the rotor and the second face of the rotor being disposed on opposing sides of the rotor, and the one or more knife receptacles being recessed into the first face of the rotor and the second face in the rotor such that one or more planar surfaces are disposed in the one or more knife receptacles and are offset from the first face of the rotor and the second face of the rotor and into the rotor to a depth substantially equal to a thickness of one or more knife inserts, where at least a portion of the rotor is disposed between one or more knife receptacles recessed into the first face of the rotor and one or more knife receptacles recessed into the second face of the rotor, and one or more knife mounting holes; and the one or more knife inserts being polygonal in shape, and comprising:

one or more mounting holes, and a cutting edge disposed on the polygonal shaped one or more knife inserts.

2. The shredder blade of claim 1, wherein the one or more knife inserts are attached to the first face of the rotor via the knife mounting holes in the rotor and the one or more mounting holes in the knife insert.

3. The shredder blade of claim 2, wherein a fastener attaches the knife insert to the first face of the rotor via the knife mounting holes in the rotor and the one or more mounting holes in the knife insert.

4. The shredder blade of claim 1, wherein the one or more knife receptacles are positioned on a first face of the rotor to expose the cutting edge disposed on the one or more knife inserts when the knife insert is attached to the rotor.

5. The shredder blade of claim 4, wherein another of the one or more knife receptacles are positioned on an opposing face of the rotor, which is opposite the first face of the rotor, to expose the cutting edge disposed on the one or more knife inserts when the knife insert is attached to the opposing face of the rotor.

6. The shredder blade of claim 5, wherein the one or more knife receptacles positioned on the first face of the rotor position the knife insert to expose a cutting edge of the knife insert at a position that is staggered from the position of a knife insert attached to the one or more knife receptacles positioned on the opposing face of the rotor.

7. The shredder blade of claim 1, wherein the one or more knife inserts each include a plurality of cutting edges.

8. The shredder blade of claim 7, wherein the plurality of cutting edges are disposed along a first edge of the one or more knife inserts.

9. The shredder blade of claim 8, wherein the plurality of cutting edges are disposed along a first surface of the first edge of the one or more knife inserts.

10. The shredder blade of claim 8, wherein the plurality of cutting edges are disposed along a second surface of the first edge of the one or more knife inserts.

11. The shredder blade of claim 1, wherein at least one of the one or more polygonal shaped knife inserts are shaped to be received into at least one of the knife receptacles on the rotor.

12. The shredder blade of claim 11, wherein the at least one of the knife receptacles on the rotor is disposed to accept the at least one of the one or more polygonal shaped knife inserts in at least a first position and a second position, the second position being a clockwise or counterclockwise rotation of the knife insert.

13. The shredder blade of claim 11, wherein the at least one of the knife receptacles on the rotor is disposed to accept the at least one of the one or more polygonal shaped knife inserts in a first position and a second position, the second position being a flipped rotation of the knife insert.

14. A shredder machine, comprising, a first shredder blade, comprising one or more knife receptacles and one or more knife mounting holes in a first rotor, the one or more knife receptacles being recessed into a first face of the first rotor and a second face of the first rotor, the first face of the first rotor and the second face of the first rotor being disposed on opposing sides of the first rotor, and the one or more knife receptacles being recessed into the first face of the first rotor and the second face in the first rotor such that one or more planar surfaces are disposed in the one or more knife receptacles and are offset from the first face of the first rotor and the second face of the first rotor and into the first rotor to a depth substantially equal to a thickness of one or more knife inserts, where at least a portion of the first rotor is disposed between one or more knife receptacles recessed into the first face of the first rotor and one or more knife receptacles recessed into the second face of the first rotor;

a second shredder blade, comprising one or more knife receptacles and one or more knife mounting holes in a second rotor, the one or more knife receptacles being recessed into a first face of the second rotor and a second face of the second rotor, the first face of the second rotor and the second face of the second rotor being disposed on opposing sides of the second rotor, and the one or more knife receptacles being recessed into the first face of the second rotor and the second face in the second rotor such that one or more planar surfaces are disposed in the one or more knife receptacles and are offset from the first face of the second rotor and the second face of the second rotor and into the second rotor to a depth substantially equal to a thickness of one or more knife inserts, where at least a portion of the second rotor is disposed between one or more knife receptacles recessed into the first face of the second rotor and one or more knife receptacles recessed into the second face of the second rotor;

the one or more knife inserts being polygonal in shape and comprising one or more mounting holes and a cutting edge disposed on the polygonal shaped one or more knife inserts.

15. The shredder machine of claim 14, wherein the first shredder blade is mounted on a first shaft and the second shredder blade is mounted on a second shaft.

16. The shredder machine of claim 15, wherein the first shredder blade mounted on the first shaft rotates in a first direction and wherein the second shredder blade mounted on the second shaft rotates in a second direction, opposite the first direction.

17. The shredder machine of claim 16, further comprising a third shredder blade comprising one or more knife receptacles and one or more knife mounting holes mounted on the first shaft and separated from the first shredder blade by a spacer, wherein at least a portion of the second shredder blade is disposed between the first shredder blade and the third shredder blade as the second shredder blade rotates on the second shaft.

* * * * *